United States Patent [19]

Vandervaart

[11] 4,415,023

[45] Nov. 15, 1983

[54] HEAT EXCHANGER HOUSING WITH AIR DEFLECTING BAFFLE AND HINGE DOOR

[75] Inventor: Gerry Vandervaart, Niagara Falls, Canada

[73] Assignee: Kool-Fire Limited, Niagara Falls, Canada

[21] Appl. No.: 269,947

[22] Filed: Jun. 3, 1981

[51] Int. Cl.[3] ..... F24H 3/06; F24H 9/02; F28F 13/06

[52] U.S. Cl. ..... 165/122; 165/29; 165/77; 62/508; 312/236

[58] Field of Search ..... 62/508, 148, 276, 479, 62/481, 476; 165/29, 77, 122; 431/114, 202, 350; 312/100, 236; 126/41 C, 41 D, 77, 112

[56] References Cited

U.S. PATENT DOCUMENTS

| | | | |
|---|---|---|---|
| 1,607,175 | 11/1926 | Seifert | 431/350 |
| 1,835,332 | 12/1931 | Pinckard | 126/77 |
| 3,078,365 | 2/1963 | Atkins et al. | 431/1 |
| 3,157,227 | 11/1964 | Palmer | 165/29 |
| 4,056,947 | 11/1977 | Partsch | 62/476 |
| 4,128,389 | 12/1978 | Straitz | 431/202 |
| 4,234,526 | 11/1980 | Mackay et al. | 312/236 |
| 4,343,288 | 8/1982 | Tjosvold | 126/112 |

FOREIGN PATENT DOCUMENTS

| | | | |
|---|---|---|---|
| 569294 | 1/1933 | Fed. Rep. of Germany | 431/350 |
| 1273110 | 7/1968 | Fed. Rep. of Germany | 431/350 |
| 2825231 | 12/1978 | Fed. Rep. of Germany | 126/112 |
| 1042154 | 10/1953 | France | 165/122 |

*Primary Examiner*—William R. Cline
*Assistant Examiner*—John M. Kramer
*Attorney, Agent, or Firm*—Diller, Ramik & Wight

[57] ABSTRACT

This disclosure is directed to a heat exchanger housing which includes an upstanding peripheral wall terminating in an upper peripheral terminal edge spanned by a cover and having disposed thereat an air-restricting baffle for restricting the flow of ambient air into the housing through a space between the cover and the upstanding peripheral wall to reduce the possibility of an open flame being blown out by high air movement exteriorly of the housing when the heat exchanger is operating under its heat-augmented mode of operation, the housing further including an upper transversely disposed generally Z-shaped supporting bar to support the cover in overlying spaced relationship to the housing peripheral wall.

28 Claims, 4 Drawing Figures

3
3
4
4
70
16
61
34
22
36
40
38
42
44
37
41
F
F
S1
17
63
64
65
26
32
33
43
S
S1
25
S2
15
S3
71
S4
73
72
21
35
30
28
28

16
34
S2
S3
22
17
61
62
18
70
S1
26

HEAT EXCHANGER HOUSING WITH AIR DEFLECTING BAFFLE AND HINGE DOOR

The present invention is directed to a novel heat exchanger which forms an improvement of the "Heat-Augmented Heat Exchanger" disclosed in applicant's corresponding U.S. patent application Ser. Nos. 54,647 and 87,154 filed on July 3, 1979 and Oct. 22, 1979, respectively, and now respective U.S. Pat. Nos. 4,311,191 and 4,311,192.

In the latter-noted applications a heat exchanger is disclosed in which an outdoor coil is disposed in a housing and is exposed to ambient air and also to heat other than ambient air by, for example, a gas burner. At relatively high outdoor ambient temperatures, the gas burner of auxiliary heat of any kind is unnecessary and heat is simply absorbed by the outdoor coil from the ambient air by the heat exchange medium (Freon) passing through the coils of the outdoor coil and the heat thus absorbed generally is sufficient to drive the heat exchange medium (Freon) from its liquid to its vapor phase with the latter being utilized for indoor heating purposes. In the preferred form of the invention, the outdoor coil is preferably, though not necessarily, an "A-coil".

When ambient outdoor temperatures drop below a predetermined temperature, the efficiency of conventional heat exchangers drops drastically and in accordance with the "heat-augmented" mode of operation of the present heat exchanger, the "A-coil" is subject to heat from the flames from a gas burner, thus augmenting ambient heat and increasing the overall efficiency of the heat exchanger. During the heat-augmented mode of operation of the heat exchanger, an associated fan is de-energized and the heat from the gas burner simply rises by convection current heating the Freon pumped through the "A-coil". During the latter operation, it is, of course, extremely important that the flame of the gas burner is not extinguished by, for example, high outdoor winds which penetrate the heat exchanger housing resulting in the extinguishing of the gas burner flame. However, the reciprocal of the latter is also important, namely, sufficient ambient air volumetrically speaking must be drawn through the housing by the fan when the latter is operative (and the gas burner is inoperative) to draw as much ambient air past the "A-coil" as is possible to assure maximum efficiency during the normal on nonheat-augmented mode of operation of the heat exchanger. Thus, the present invention seeks and provides a balance between providing a heat exchanger housing which prevents the flames of the gas burner from being extinguished during the heat-augmented mode of operation of the heat exchanger while permitting an ample supply of ambient air to be drawn through the housing during the nonheat-augmented mode of operation of the heat exchanger.

In accordance with the foregoing, it is a primary object of this invention to provide a novel housing for a heat exchanger which includes a generally upstanding peripheral wall having an upper peripheral end portion terminating in an upper peripheral edge above which and in surrounding relationship thereto is a cover having an end wall and a depending peripheral skirt in exterior spaced relationship to the upper peripheral end portion of the heat exchanger housing, and means for restricting the flow of air into the housing through a peripheral space defined between the cover and the upper peripheral terminal edge of the housing wall whereby during the generation of an open flame by a gas burner within the housing, the restricted air flow reduces the possibility of the open flame being blown out by high air movement (winds) exteriorly of the housing.

Still another object of this invention is to provide a novel heat exchanger housng of the type heretofore described wherein the air flow restricting means is an air deflecting panel or baffle which in its most specific configuration is of a generally Z-shaped transverse cross section defined by a pair of legs and a web therebetween with one of the legs being in external spaced and generally parallel relationship to the depending peripheral skirt of the cover.

Still another object of this invention is to provide a novel heat exchanger housing which includes therein a partition for setting off a pair of chambers within the housing and opening in the partition means generally aligned with an opening in the housing peripheral wall, and means disposed generally in a first of the chambers for drawing air through the first chamber and blowing the same outwardly therefrom through the partition means and into a second of the chambers toward the opening of the peripheral housing wall, and a door normally closing the latter-noted opening which will swing to its open position under the air flow from the fan means during the non-heat-augmented mode of operation of the heat exchanger, yet will close the opening in the peripheral wall during the heat-augmented mode of operation of the heat exchanger.

With the above and other objects in view that will hereinafter appear, the nature of the invention will be more clearly understood by reference to the following detailed description, the appended claims and the several views illustrated in the accompany drawings.

Figure 1:
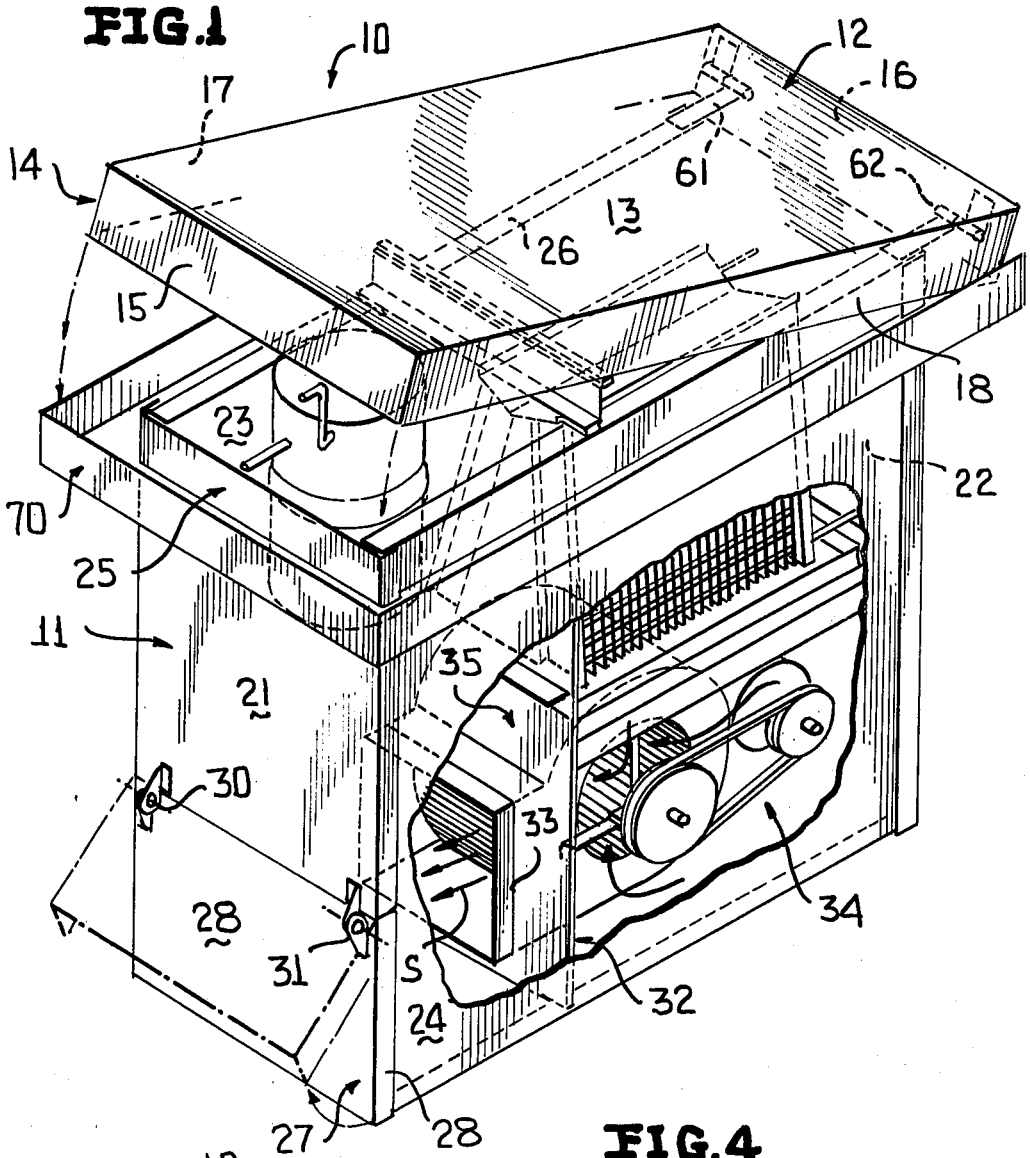
FIG. 1 is a perspective view of a novel heat exchanger constructed in accordance with this invention, and illustrates a housing which includes an upper peripheral wall, an air baffle exteriorly surrounding the same, and a hinged cover associated with the baffles to restrict the flow of air from the exterior of the housing into the interior thereof.

A novel heat exchanger constructed in accordance with this invention is generally designated by the reference numeral 10 and includes as part thereof a housing 11 and a cover 12.

The cover 12 includes an end wall 13 and a peripheral wall 14 with the latter being defined by opposite generally parallel end panels 15, 16 and opposite generally parallel side panels 17, 18.

The housing 11 includes a pair of opposite upstanding generally parallel end panels 21, 22 (FIGS. 1 and 2) and opposite upstanding generally parallel side panels 23, 24. The panels 21 through 24 are united in a conventional manner as by nuts, sheet metal screws, bolts and the like and collectively define an upper peripheral end portion 25 of the housing 11 terminating in upper peripheral terminal edge 26.

The end panel 21 is shorter than the end panel 22 (FIGS. 1 and 2), and thereby defines a generally rectangular opening 27 which is normally closed by a generally rectangular door 28 which is connected for free pivoting or hinging action to the panel 21 by conventional hinges 30, 31 having respective halves (unnumbered) secured to the end panel 21 and to the door 28. The door 28 normally lies in the same plane as the end panel 21, as is shown in solid outline in FIG. 1, but can be moved to the phantom outline position shown in FIG. 1 by a stream S of air which will be described more fully hereinafter in conjunction with FIGS. 1 and 2 of the drawings.

Means generally designated by the reference numeral 32 is a partition wall which is disposed in spaced parallel relationship to the panels 21, 22, and includes at a lowermost portion thereof a generally rectangular opening 33. The partition wall or panel 32 sets off a pair of compartments or chambers 34, 35 with the chamber 34 being further divided into upper and lower chamber portions (unnumbered) by a generally horizontally disposed partition or plate 36 having a central opening 37 surrounded by a generally annular reservoir 38 in which rests a lower end portion (unnumbered) of an "A-coil" 40. A gas burner 41 is operative in the manner more fully disclosed in the latter-mentioned applications and when conventionally ignited by an electric igniter generates flames F during the heat-augmenting mode of operation of the heat exchanger 10 during which operation a motor 42 is de-energized and, thus, an associated fan 43 will not rotate through the inoperative drive connection of a belt 44. However, when the heat exchanger 10 is operating in its nonheat-augmenting mode of operation, the gas burner 41 is de-energized and the motor 42 is energized to drive the fan 43 through the belt 44 and thus draw air from the exterior of the housing 11 through spaces which will be described immediately hereinafter, as is indicated by the unnumbered headed arrows at the upper portion of FIGS. 2 and 4 of the drawings.

Figure 4:
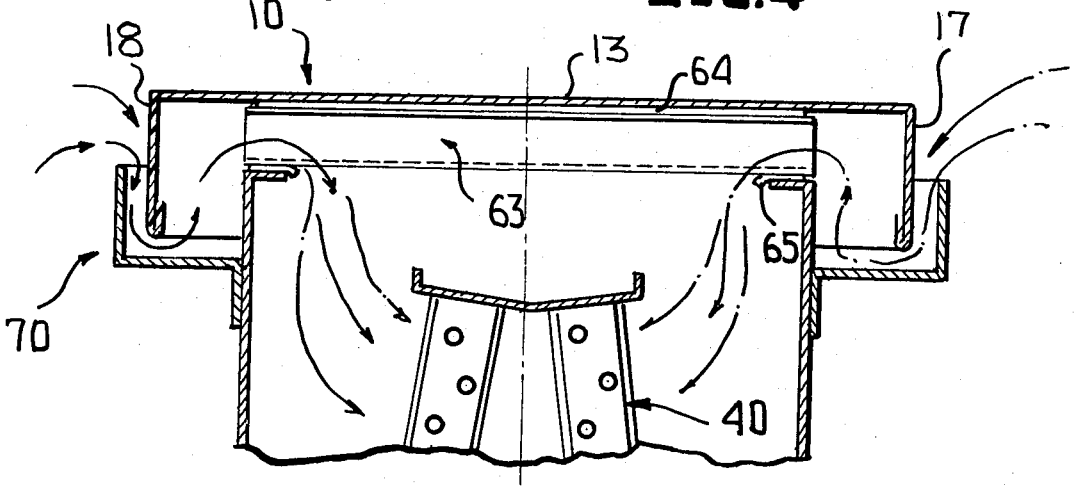
FIG. 4 is a fragmentary sectional view taken generally along line 4—4 of FIG. 2, and illustrates the manner in which the air drawn into the housing is also drawn through the "A-coil" by the fan positioned therebeneath.
Figure 2:
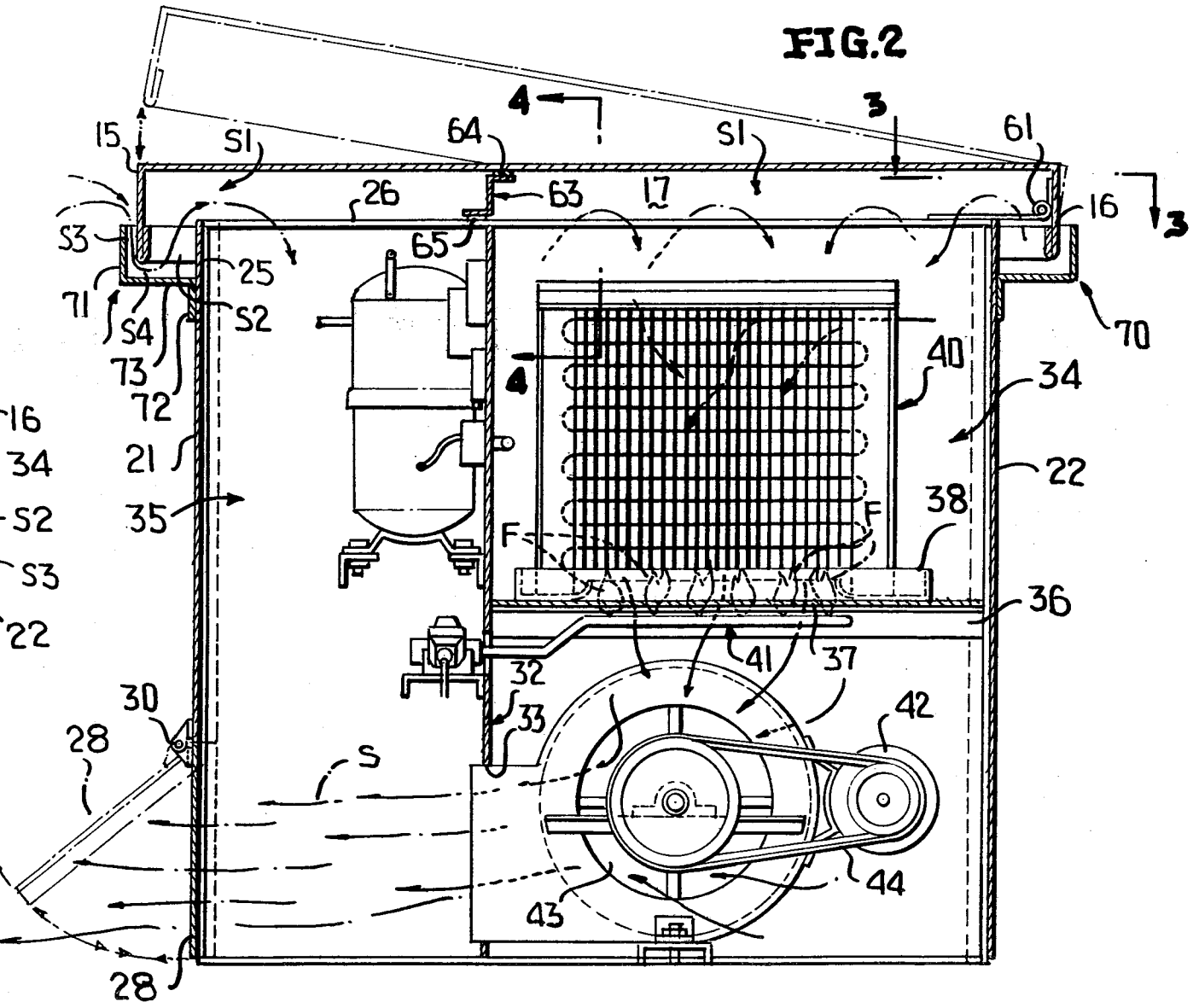
FIG. 2 is a longitudinal sectional view taken thrugh the heat exchanger of FIG. 1, and illustrates the manner in which the baffle creates a restrictive path of travel for air into the interior of the housing, and the manner in which a hinged door is blown open during the operation of the heat-exchanger in its nonheat-augmented mode of operation.
Figure 3:
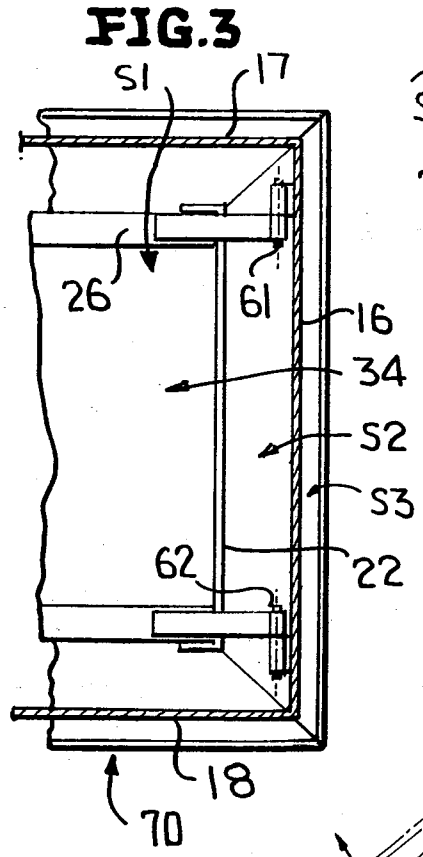
FIG. 3 is a cross-sectional view taken generally along line 3—3 of FIG. 2, and illustrates a pair of hinges connecting the cover to the housing.

The cover 13 is secured to the upper peripheral end portion 25 and more specifically to the terminal edge 26 of the housing 11 by a pair of hinges 61, 62 which facilitate the pivoting or hinging of the cover 12 from its closed (solid line position in FIGS. 2 through 4) and an open position shown in solid outline in FIG. 1 and in phantom outline in FIG. 2. The cover 12 can be pivoted about the hinges 61, 62 to an almost upright position to gain access to the interior of the housing 11, but only a partially open position is illustrated since the degree of opening of the cover 12 is of no moment relative to the present invention. A central portion of the cover 12 is supported by a cover support member 63 which transversely spans and is seated upon the upper peripheral terminal edge 26 of the housing 11 and is thereat bolted to the side panels or walls 22, 23. The cover support member is generally Z-shaped in transverse cross section (FIG. 2) and includes an upper strip of sound damping material 64 and a lower strip of sound damping material 65, respectively sandwiched between flanges (unnumbered) of the cover support member and the end panel 13 and the upper terminal edge 26. The end wall 13 of the cover 12 rests upon the strip 64 of sound-deadening material and, of course, the function of the cover support member 63 is to maintain the cover 12 spaced from the upper end portion 25 of the housing 11. More specifically, the cover support member 63 supports the end wall 13 above the terminal peripheral edge 26 such as to define a space S1 therebetween (FIGS. 2 and 4). Furthermore, since the peripheral skirt 14 of the cover 12 is larger than that of the upper peripheral portion 25 of the housing 11, the latter two elements (14 and 25) collectively define therebetween a spaced S2 which is, of course, in communication with the space S1 about the entire periphery or upper terminal edge portion 26 of the housing 11 and in the absence of other structure would permit generally unrestricted air flow from the exterior of the housing 11 into the chambers 34, 35 through the spaces S1, S2.

In keeping with the present invention, it is necessary that the flames F not be extinguished during the heat-augmented mode of operation of the heat exchanger 10 by the unrestricted flow of air, such as high winds, into the chambers 34, 35 through the spaces S1, S2. In order to achieve the latter desired end, means generally designated by the reference numeral 70 is provided for restricting the flow of air into the housing 11 through the spaces S1, S2. The means 70 constitute air flow restricting means in the form of an air deflecting panel or baffle disposed in generally surrounding spaced telescopic relationship to the upper peripheral end portion 25 of the housing 11 and to the peripheral skirt 14 of the cover 12. The air deflecting panel or baffle 70 includes an upwardly directed leg 71, a downwardly directed leg 72, and a bight or wall 73 therebetween which is disposed in a generally horizontal plane. The wall 71 is in generally parallel spaced relationship to the panels 15 through 18 of the cover 12 and thus defines a third space S3 therebetween. Similarly, the horizontal wall portion 73 is below and spaced from a terminal edge (unnumbered) of the terminal edges of the panels 15 through 18 of the cover 12 thereby defining another space S4 therebetween. Accordingly, for air, and particulary high winds, to enter into the chambers 34, 35, and particularly the chamber 34, the air must follow the generally sinusoidal path into and through the space S3, the space S4, the space S2 and thence the space S1 into the chambers 34 and 35. By thus providing the baffle 70 in the manner described, it is difficult if not impossible for high winds exteriorly of the housing 11 to adversely effect and more particularly extinguish the flames F of the gas burner 41. However, as important as it is to assure that the flames F are not extinguished during the heat-augmenting mode of operation of the heat exchanger 10, it is also necessary that when the heat exchanger is operating in its nonheat-augmenting mode (flames F extinguished), sufficient air can still be drawn through the spaces S3, S4, S2, S1 from exteriorly across, into and through the coils of the "A-coil" 40 (FIG. 4) and thence back outwardly to atmosphere under the influence of the fan 43 and, of course, the opening of the door 28. To the latter end, the spaces S1 through S4 permit such flow of ambient air into the interior of the housing and particularly into the chamber 34 such that the "A-coil" 40 operates efficiently and extracts from an appreciable volume of air flow the particular energy available. Thus, the heat exchanger 10 corresponds in operation generally to that set forth in the latternoted applications and further details in regard to the specifics thereof may be had to the latter applications. However, in keeping with the present invention, the significant factors are the provision of the various elements which define the air restricting means 70 which prevent the flames F from being blown out by high winds exterior of the housing 11 during which time the fan 43 is inoperative and, of course, the door 28 is normally closed while allowing unrestricted, generally speaking, air flow through the same spaces S1 through S4 during the nonheat-augmented operation of the heat exchanger 10 when the fan 43 is operative and the gas burner 41 is inoperative.

Although only a preferred embodiment of the invention has been specifically illustrated and described herein, it is to be understood that minor variations may be made in the apparatus without departing from the spirit and scope of the invention, as defined in the appended claims.

I claim:

1. A housing for a heat exchanger comprising a generally upstanding peripheral wall having an upper peripheral end portion terminating in an upper peripheral terminal edge, a cover over said upper peripheral end portion, said cover being defined by an end wall and a depending peripheral skirt, said upper peripheral terminal edge being spaced from said end wall and defining therebetween a first space, said peripheral skirt and upper peripheral end portion being in relatively spaced telescopic relationship and defining therebetween a second space in communication with said first space whereby air can flow through said spaces from the exterior to the interior of said housing, further means disposed contiguous said upper peripheral end portion and said terminal edge for restricting the flow of air into said housing through said spaces about substantially the entire peripheral-extent thereof, and means for generating an open flame in said housing whereby the restricted air flow within said housing reduces the possibility of the open flame being blown out by high air movement exteriorly of said housing.

2. The housing as defined in claim 1 wherein said air flow restricting means is an air deflecting panel disposed in generally spaced telescopic relationship to said upper peripheral end portion and said peripheral skirt.

3. The housing as defined in claim 1 wherein said air flow restricting means is an air deflecting panel disposed in generally spaced telescopic relationship to said upper peripheral end portion and said peripheral skirt, and said peripheral skirt is in spaced sandwiched relationship between said upper peripheral end portion and said air deflecting panel thereby defining a third space therebetween through which exterior air must flow to reach said second space.

4. The housing as defined in claim 1 wherein said air flow restricting means is an air deflecting panel disposed in generally spaced telescopic relationship to said upper peripheral end portion and said peripheral skirt, said peripheral skirt is in spaced sandwiched relationship between said upper peripheral end portion and said air deflecting panel thereby defining a third space therebetween through which exterior air must flow to reach said second space, and said air deflecting panel includes a portion spaced beneath a terminal edge of said peripheral skirt and defining therewith a fourth space between said second and third spaces.

5. The housing as defined in claim 1 including means for hinging said cover to said upper peripheral end portions for movement between open and closed positions.

6. The housing as defined in claim 1 including means for hinging said cover to said upper peripheral end portions for movement between open and closed positions, and a cover support member transversely spanning and seated upon said upper peripheral terminal edge for engagingly supporting said end wall when said cover is closed.

7. The housing as defined in claim 1 including means for hinging said cover to said upper peripheral end portions for movement between open and closed positions, a cover support member transversely spanning and seated upon said upper peripheral terminal edge for engagingly supporting said end wall when said cover is closed, and sound damping means between said end wall and said cover support member.

8. The housing as defined in claim 1 including means for hinging said cover to said upper peripheral end portions for movement between open and closed positions, a cover support member transversely spanning and seated upon said upper peripheral terminal edge for engagingly supporting said end wall when said cover is closed, and said cover support member being of a generally Z-shaped cross-sectional configuration.

9. The housing as defined in claim 1 including means for hinging said cover to said upper peripheral end portions for movement between open and closed positions, a cover support member transversely spanning and seated upon said upper peripheral terminal edge for engagingly supporting said end wall when said cover is closed, sound damping means between said end wall and said cover support member, and said cover support member being of a generally Z-shaped cross-sectional configuration.

10. The housing as defined in claim 1 including an opening in said peripheral wall, a door normally closing said opening, and fan means for normally drawing air from the exterior of said housing through said spaces and directing the same toward said door to open the latter to exhaust the air from said housing.

11. The housing as defined in claim 10 wherein said opening and door are disposed at a lower end portion of said peripheral wall.

12. The housing as defined in claim 10 including partition means for setting off a pair of chambers within said housing, an opening in said partition means generally aligned with said peripheral wall opening, and said fan means being disposed generally in a first of said chambers for drawing air through said first chamber and blowing the same outwardly therefrom through said partition means opening and into a second of said pair of chambers toward said peripheral wall opening.

13. The housing as defined in claim 10 wherein said air flow restricting means is an air deflecting panel disposed in generally spaced telescopic relationship to said upper peripheral end portion and said peripheral skirt.

14. The housing as defined in claim 10 wherein said air flow restricting means is an air deflecting panel disposed in generally spaced telescopic relationship to said upper peripheral end portion and said peripheral skirt, and said peripheral skirt is in spaced sandwiched relationship between said upper peripheral end portion and said air deflecting panel thereby defining a third space therebetween through which exterior air must flow to reach said second space.

15. The housing as defined in claim 10 wherein said air flow restricting means is an air deflecting panel disposed in generally spaced telescopic relationship to said upper peripheral end portion and said peripheral skirt, said peripheral skirt is in spaced sandwiched relationship between said upper peripheral end portion and said air deflecting panel thereby defining a third space therebetween through which exterior air must flow to reach said second space, and said air deflecting panel includes a portion spaced beneath a terminal edge of said peripheral skirt and defining therewith a fourth space between said second and third spaces.

16. The housing as defined in claim 10 including means for hinging said cover to said upper peripheral end portions for movement between open and closed positions.

17. The housing as defined in claim 10 including means for hinging said cover to said upper peripheral end portions for movement between open and closed positions, and a cover support member transversely spanning and seated upon said upper peripheral terminal edge for engagingly supporting said end wall when said cover is closed.

18. The housing as defined in claim 10 including means for hinging said cover to said upper peripheral end portions for movement between open and closed positions, a cover support member transversely spanning and seated upon said upper peripheral terminal edge for engagingly supporting said end wall when said cover is closed, and sound damping means between said end wall and said cover support member.

19. The housing as defined in claim 10 including means for hinging said cover to said upper peripheral end portions for movement between open and closed positions, a cover support member transversely spanning and seated upon said upper peripheral terminal edge for engagingly supporting said end wall when said cover is closed, sound damping means between said end wall and said cover support member, and said cover support member being of a generally Z-shaped cross-sectional configuration.

20. The housing as defined in claim 12 wherein said air flow restricting means is an air deflecting panel disposed in generally spaced telescopic relationship to said upper peripheral end portion and said peripheral skirt.

21. The housing as defined in claim 12 wherein said air flow restricting means is an air deflecting panel disposed in generally spaced telescopic relationship to said upper peripheral end portion and said peripheral skirt, and said peripheral skirt is in spaced sandwiched relationship between said upper peripheral end portion and said air deflecting panel thereby defining a third space therebetween through which exterior air must flow to reach said second space.

22. The housing as defined in claim 12 wherein said air flow restricting means is an air deflecting panel disposed in generally spaced telescopic relationship to said upper peripheral end portion and said peripheral skirt, said peripheral skirt is in spaced sandwiched relationship between said upper peripheral end portion and said air deflecting panel thereby defining a third space therebetween through which exterior air must flow to reach said second space, and said air deflecting panel includes a portion spaced beneath a terminal edge of said peripheral skirt and defining therewith a fourth space between said second and third spaces.

23. The housing as defined in claim 12 wherein said peripheral wall opening is disposed at a lower end portion of said peripheral wall.

24. The housing as defined in claim 23 wherein said air flow restricting means is an air deflecting panel disposed in generally spaced telescopic relationship to said upper peripheral end portion and said peripheral skirt.

25. The housing as defined in claim 23 wherein said air flow restricting means is an air deflecting panel disposed in generally spaced telescopic relationship to said upper peripheral end portion and said peripheral skirt, and said peripheral skirt is in spaced sandwiched relationship between said upper peripheral end portion and said air deflecting panel thereby defining a third space therebetween through which exterior air must flow to reach said second space.

26. The housing as defined in claim 23 wherein said air flow restricting means is an air deflecting panel disposed in generally spaced telescopic relationship to said upper peripheral end portion and said peripheral skirt, said peripheral skirt is in spaced sandwiched relationship between said upper peripheral end portion and said air deflecting panel thereby defining a third space therebetween through which exterior air must flow to reach said second space, and said air deflecting panel includes a portion spaced beneath a terminal edge of said peripheral skirt and defining therewith a fourth space between said second and third spaces.

27. The housing as defined in claim 12 wherein said open flame generating means is located in said first chamber.

28. The housing as defined in claim 12 including means for deactivating said open flame generating means when said fan means is activated.

* * * * *